US007594465B2

(12) United States Patent
Borgwarth et al.

(10) Patent No.: US 7,594,465 B2
(45) Date of Patent: Sep. 29, 2009

(54) IN BORE AIR REGULATION SYSTEM

(75) Inventors: Dennis W. Borgwarth, Andover, MN (US); John F. Revolinski, Minneapolis, MN (US); Chad L. Hellwig, Maple Grove, MN (US); Jeffrey V. Ireland, Rosemount, MN (US)

(73) Assignee: BAE Systems Land & Armaments L.P., Arlington, VA (US)

( * ) Notice: Subject to any disclaimer, the term of this patent is extended or adjusted under 35 U.S.C. 154(b) by 225 days.

(21) Appl. No.: 10/794,416

(22) Filed: Mar. 5, 2004

(65) Prior Publication Data

US 2004/0244572 A1 Dec. 9, 2004

Related U.S. Application Data

(60) Provisional application No. 60/520,419, filed on Nov. 14, 2003, provisional application No. 60/452,785, filed on Mar. 7, 2003.

(51) Int. Cl.
*F41A 3/00* (2006.01)

(52) U.S. Cl. ..... 89/17; 89/26; 89/193

(58) Field of Classification Search ..... 89/17, 89/26, 193; 124/73
See application file for complete search history.

(56) References Cited

U.S. PATENT DOCUMENTS

| | | | | | |
|---|---|---|---|---|---|
| 2,960,977 | A | * | 11/1960 | Moorhead, Jr. | 124/70 |
| 3,628,415 | A | | 12/1971 | McElroy | |
| 4,872,471 | A | * | 10/1989 | Schneider | 137/68.14 |
| 5,429,034 | A | * | 7/1995 | Badali et al. | 89/193 |
| 5,703,318 | A | * | 12/1997 | Franchino et al. | 89/37.07 |
| 6,257,148 | B1 | | 7/2001 | Toivonen | |
| 6,553,983 | B1 | * | 4/2003 | Li | 124/73 |
| 6,851,348 | B1 | * | 2/2005 | Ang | 89/26 |
| 6,904,901 | B2 | * | 6/2005 | Mitchell | 124/65 |
| 2004/0216598 | A1 | * | 11/2004 | Guesnet et al. | 89/193 |

FOREIGN PATENT DOCUMENTS

WO WO 01/02790 * 1/2001

* cited by examiner

*Primary Examiner*—Michelle (Shelley) Clement
(74) *Attorney, Agent, or Firm*—Patterson, Thuente, Skaar & Christensen, P.A.

(57) ABSTRACT

A weapon system having a gun barrel and an in bore air regulation system. The gun barrel has a first end and a second end. The gun barrel has a bore formed therein that extends from the first end towards the second end. The bore is adapted to receive a round. The in bore air regulation system is operably attached to the gun barrel so that the in bore air regulation system is in communication with the bore to regulate air pressure in the bore and thereby control the position of the round in the bore.

6 Claims, 9 Drawing Sheets

IN BORE AIR REGULATION SYSTEM

REFERENCE TO RELATED APPLICATION

The present application claims priority to U.S. Provisional Application No. 60/452,785, filed Mar. 7, 2003, and U.S. Provisional Application No. 60/520,419, filed Nov. 14, 2003. The identified provisional applications are hereby incorporated by reference in their entirety.

FIELD OF THE INVENTION

This invention provides a weapon system for firing rounds. More particularly, the present invention relates to a weapon system that uses in bore air regulation.

BACKGROUND OF THE INVENTION

Mortar rounds, which normally are used with muzzle loading weapon systems, can also be used in breech loading weapon systems employing a smooth bore gun tube, but only when the angle between the axis of the gun tube and horizontal is positive and sufficiently large for the force of gravity to assure the round is in proper engagement with the breech block of the gun.

Without such engagement, the percussion primer in the mortar round will not be activated causing the gun to misfire. The problem of holding the round against the breech face is aggravated with the additional system requirement of firing mortar systems from mobile platforms at negative elevation angles, i.e., at angles below horizontal. Under those circumstances, without some means of restraint, the round would be urged by the force of gravity to move down the gun tube away from the breech.

To compensate for such problems, the prior art has employed devices, such as stub cases and clips, which are attached to normal mortar rounds. An example of a stub case is shown in U.S. Pat. No. 6,257,148, wherein the stub case is mechanically attached to the base of the mortar round. The assignee of this patent is known to also attach a stub case by elastic straps engaging both the stub case and the fins of the round.

When stub case weapon systems are fired, the stub case separates from the round. Thereafter, the stub case must be removed from the breech. Because of the relatively high temperatures generated during the firing process, there are also issues relating to disposal of the hot stub case in a safe manner.

Another ordnance manufacturer is known to utilize a clip on the fins of the mortar round which engages a mating feature machined into the gun tube to hold the round against the breech face. Such prior art arrangements introduce complications of logistics, e.g., transportation, storage, and installation, and additional cost since both current and future rounds need hardware associated with them for use in breech loading systems, while increasing the complications and cost of using such specially configured rounds in traditional muzzle loading mortar systems. In addition, such prior art arrangements do not provide a means for safe misfire ejection, for clearing the gun bore of burning embers, or for forced convection cooling of the gun tube.

SUMMARY OF THE INVENTION

The in bore air regulation system of the present invention solves the problems associated with prior art weapon systems, while additionally providing a means for safely ejecting a misfired round without requiring handling by personnel and without moving the misfired projectile into the magazine of the vehicle, for clearing the gun tube of any residual burning embers, and for convection cooling of the gun tube when required by frequent firing.

The in bore air regulation system of the present invention holds the round in proper position within the breech by creating a low pressure vacuum in the breech block, i.e., reducing the pressure in the breech block below atmospheric, so that the pressure differential created thereby will cause the round to be pushed and held against the face of the breech block.

A valve is held open to connect the interior of the breech with a source of vacuum. Immediately prior to firing, the valve is closed so the integrity of the breech and chamber is maintained, and the vacuum components are protected from damage as the round is fired.

Even though the vacuum may begin to diminish as soon as the valve is closed, inertia and friction will retain the round in its proper position during the short interval of time between valve closing and firing of the round. The in bore air regulation system of the present invention achieves the attributes of ember clearing and forced convection cooling by selectively connecting the breech to a source of air under positive pressure through the same aforementioned valve.

DETAILED DESCRIPTION OF THE INVENTION

The present invention is directed to an in bore air regulation system for a weapon system. The in bore air regulation system of the present invention is particularly suited for use with breech loading weapon systems such as the M120 mortar system. The in bore air regulation system not only facilitates loading rounds into a firing position but also enables malfunctioning rounds to be easily and safely discharged from the weapon system.

It is possible to use the in bore air regulation system with all types of conventional rounds. The in bore air regulation system enables the weapon system to be oriented without respect to the angle of the barrel. The in bore air regulation system also operates in a highly reliable manner regardless of external factors such as temperature, humidity, dirt and dust.

Another advantage of the present invention is the in bore air regulation system of the present invention enables the weight of the weapon system to be significantly reduced compared to conventional breech loading weapon systems that utilize stub cases because the in bore air regulation systems do not use stub cases and stub case ejectors. Since stub cases are not required, it is also possible to use shorter magazines.

Figure 1:
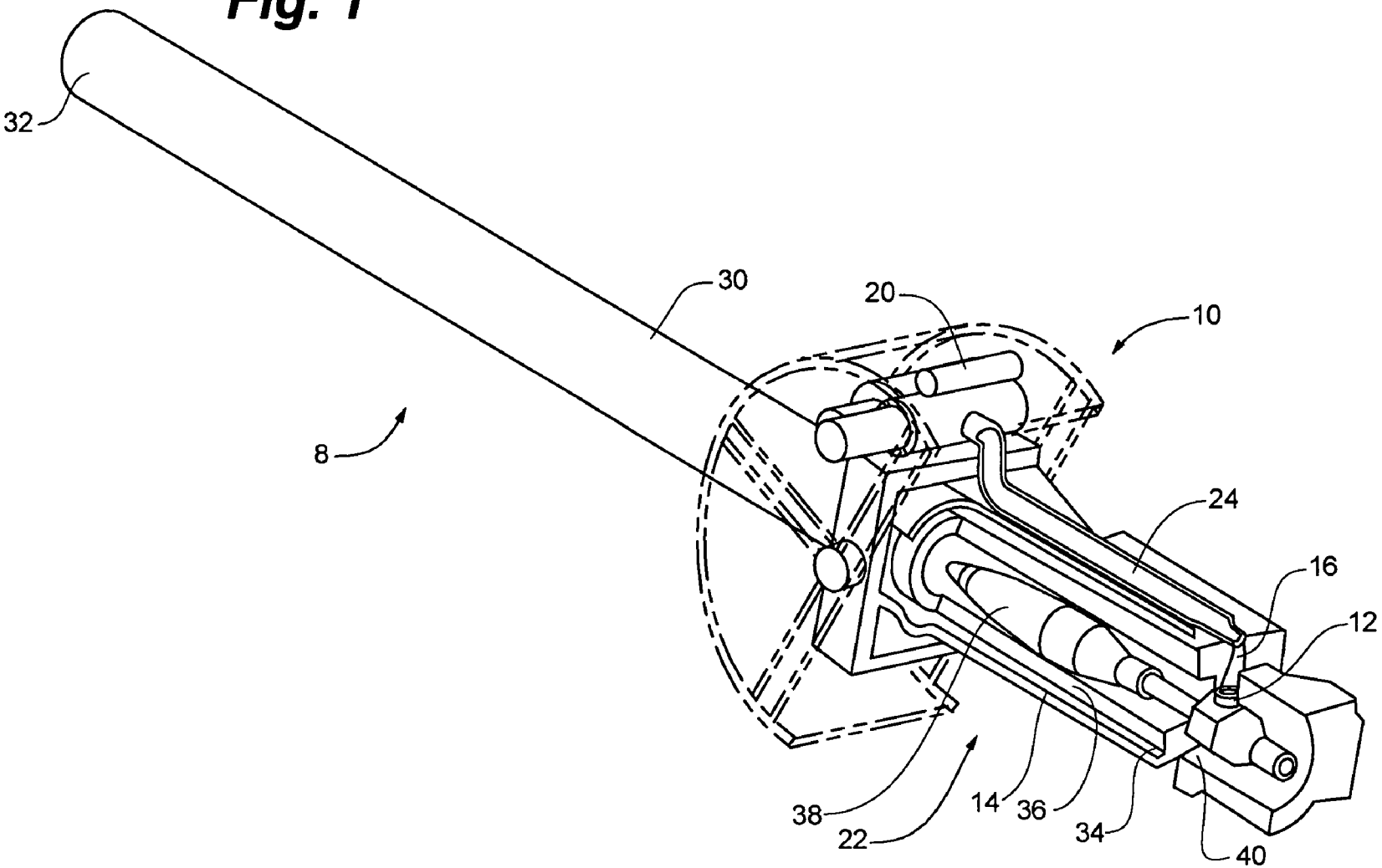
FIG. 1 is a partially broken away perspective view of a weapon system having an in bore air regulation system.

FIG. 1 depicts an in bore air regulation system 10 incorporated into a weapon system 8. The weapon system 8 in this embodiment generally includes a gun barrel 30 with a first end 32 and a second end 34. The gun barrel 30 has a bore 36 formed therein that extends from the second end 34 towards the first end 32 where a breech face 40 is located. The bore 36 is adapted to receive a round 38.

The in bore air regulation system 10 is in communication with the bore 36 through an aperture 12 formed in a barrel wall 14. A valve 16 is provided proximate the aperture 12 to protect the in bore air regulation system 10 during firing.

It is preferable to mount an air pressure generation portion 20 of the in bore air regulation system 10 on a portion of the weapon system 8 that does not recoil when firing. The air pressure generation portion 20 is in communication with the aperture 12 using a tube 24. The tube 24 preferably has a sliding configuration that is similar to a trombone that allows the tube 24 to lengthen when the weapon system 8 is fired.

Figure 2:
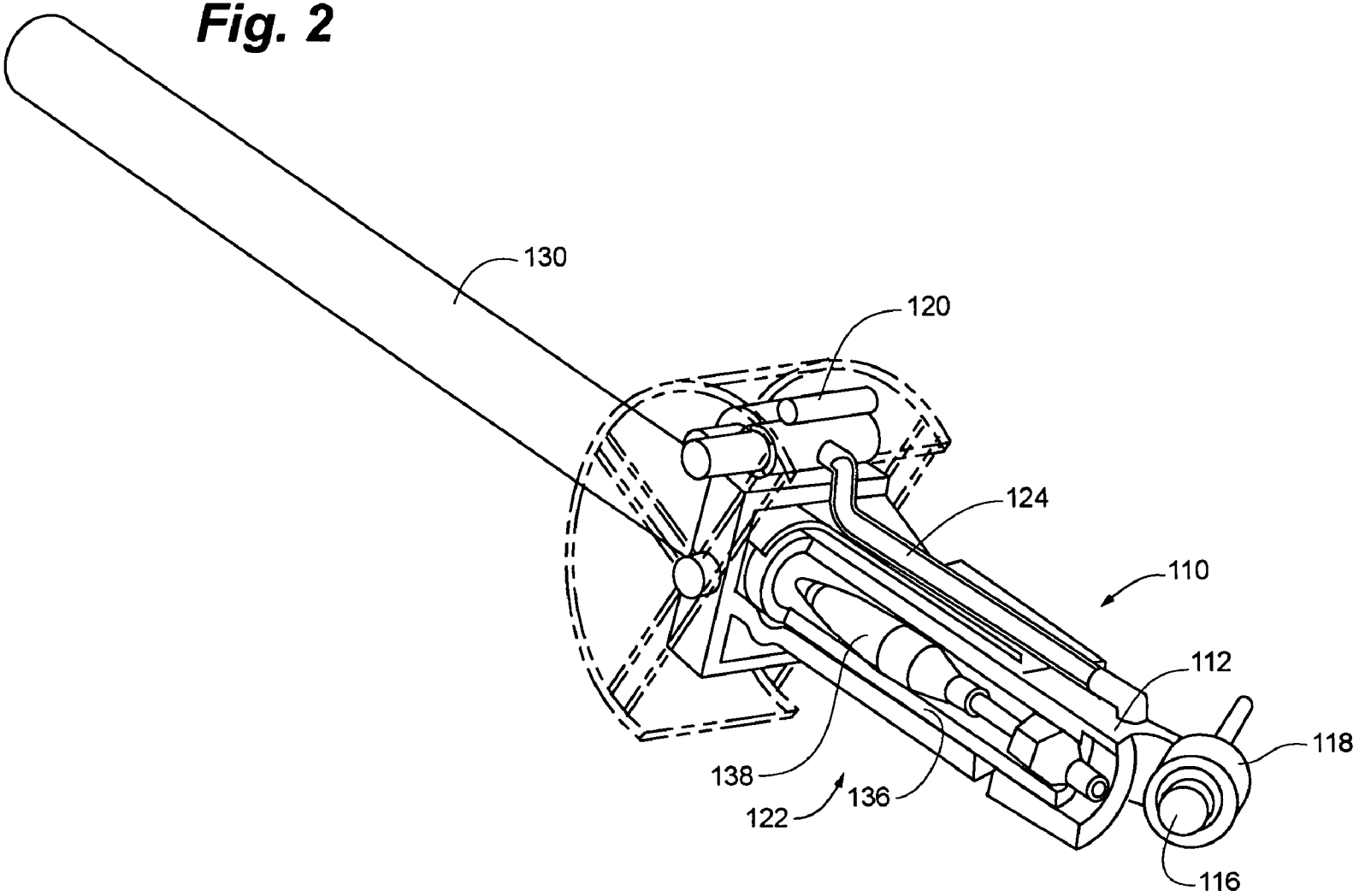
FIG. 2 is a partially broken away perspective view of an alternate weapon system having an in bore air regulation system.

FIG. 2 illustrates use of the in bore air regulation system 110 with a screw breech weapon system 122. Similar to the preceding embodiment, the weapon system 122 includes a gun barrel 130 having a bore 136 extending therethrough that is adapted to receive a round 138.

In this embodiment, an aperture 112 is formed in a screw breech 118. A valve 116 is provided in the screw breech 118 to protect the in bore air regulation system 110 during firing.

Similar to the embodiment illustrated in FIG. 1, the air pressure generation system 120 is connected to the aperture 112 with a tube 124 having a sliding configuration similar to a trombone.

Figure 3:
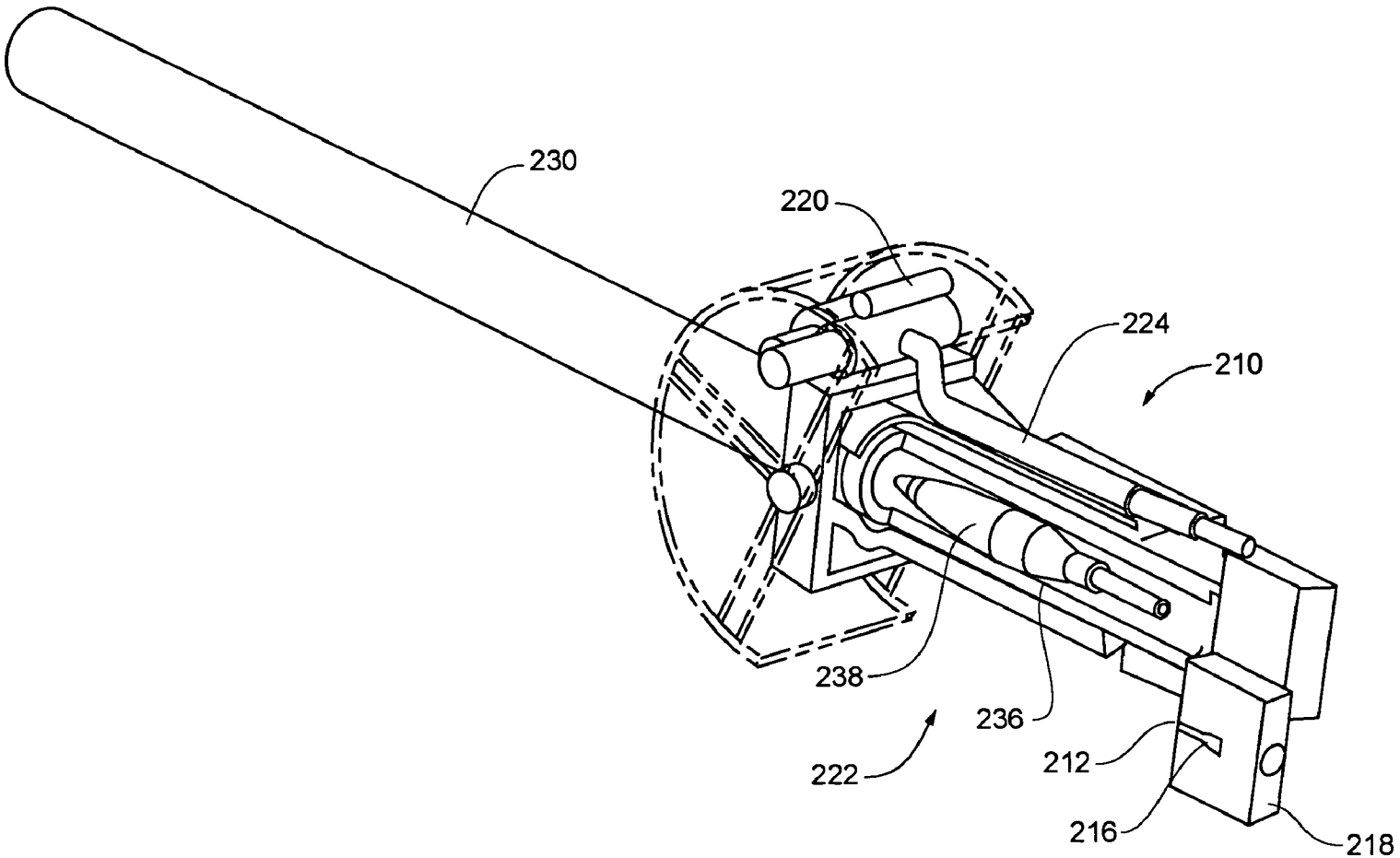
FIG. 3 is a partially broken away perspective view of another weapon system having an in bore air regulation system.

Use of the in bore air regulation system 210 with another weapon system 222 is illustrated in FIG. 3. The weapon system 222 includes a gun barrel 230 with a bore 236 extending therethrough that is adapted to receive a round 238.

This embodiment utilizes a sliding wedge breech 218. An aperture 212 is formed in the sliding wedge breech 218. A valve 216 is provided in the sliding wedge breech 218 to protect the in bore air regulation system 210 during firing.

A tube 224 connects an air pressure generation system 220 to the aperture 212. The tube preferably has a sliding configuration that is similar to a trombone.

Figure 4:
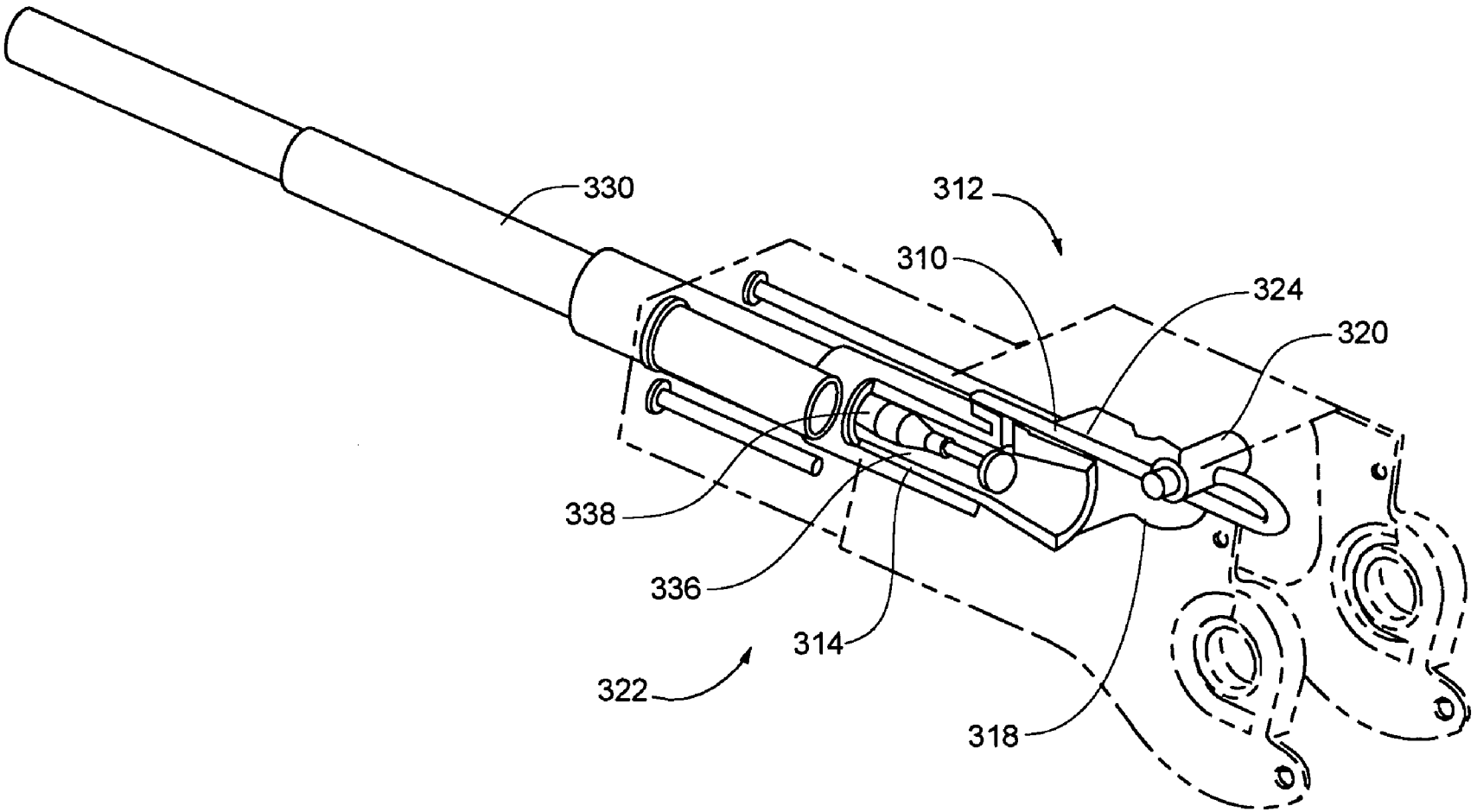
FIG. 4 is a partially broken away perspective view of yet another weapon system having an in bore air regulation system.

Still another embodiment of the present invention relates to mounting the air pressure generation system 320 behind the breech 318 of a weapon system 322, as illustrated in FIG. 4. The weapon system 322 includes a gun barrel 330 having a bore 336 extending therethrough that is adapted to receive a round 338.

In this embodiment, an aperture 312 is provided in the barrel wall 314. Tubing 324 that connects the air pressure generation system 320 with the aperture preferably includes a trombone-like sliding configuration.

FIGS. 5*a*-5*c* and 6*a*-6*b* show a breech loading weapon system 500 into which an air pressure vacuum system 510 has been incorporated. A vacuum air pump 520 is carried by the elevating mass of the gun and connected to the breech through a break away connection 550, which is most clearly illustrated in FIGS. 6*a*-6*b*.

The breakaway connection 550 reduces the mass to be absorbed by the gun's recoil mechanism by allowing the mass of the pump 520 to be attached to or otherwise carried by that portion of the weapon system 500 that does not move in recoil.

Since very low pressures differentials are involved and the flow is relatively high, this connection has negligible impact on the system performance. Thus, the break away connection 550 may be a cone shaped male member 552 mounted on either the recoil or movable mass engagable with a complementary shaped female member 554 mounted on the mass that does not move in recoil.

An O-ring interface functions as a seal between the two members when the gun is in the battery position. Using such a configuration increases a contact surface area in the breakaway mechanism 550 to enhance the performance of the in bore air regulation system 510.

Figure 5A:
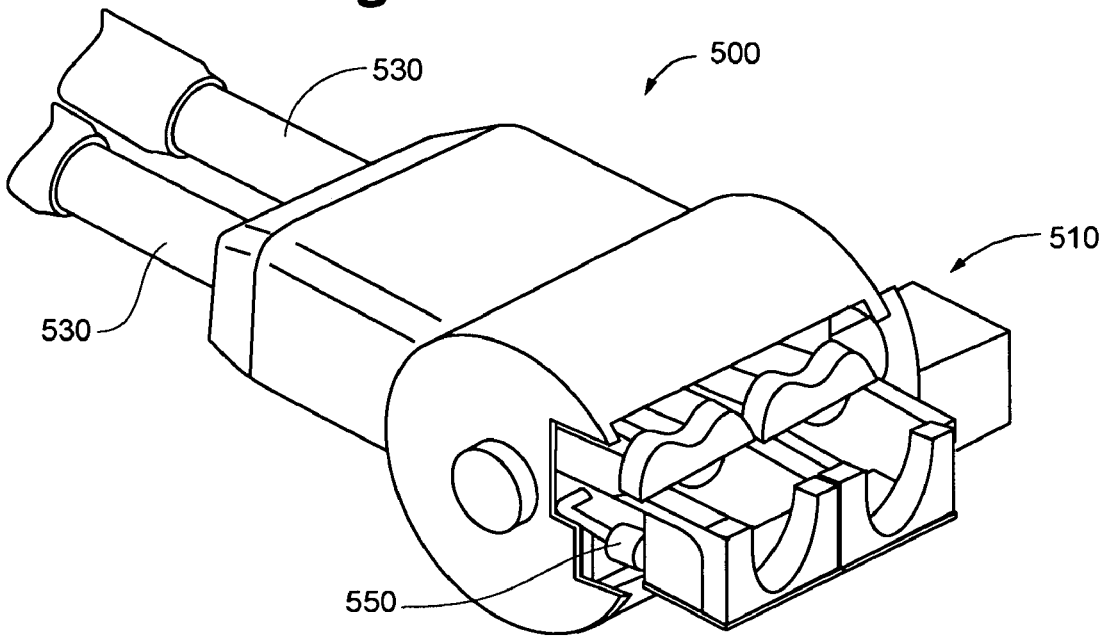
FIG. 5*a* is a perspective view of a breech loading gun having an in bore air regulation system in a battery position.
Figure 5B:
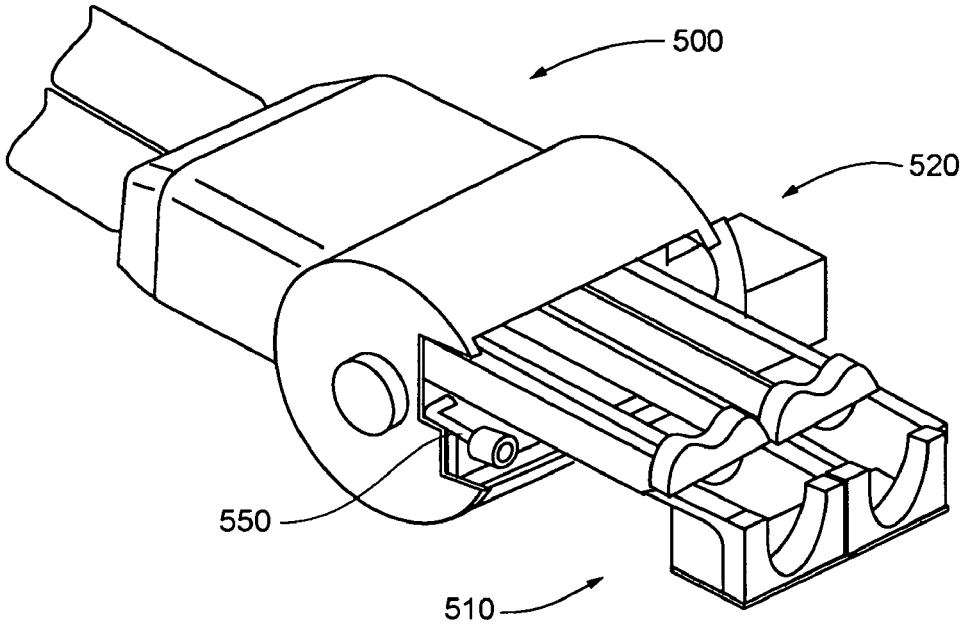
FIG. 5*b* is a perspective view of the gun shown in FIG. 6*a* with the gun in a full recoil position.
Figure 5C:
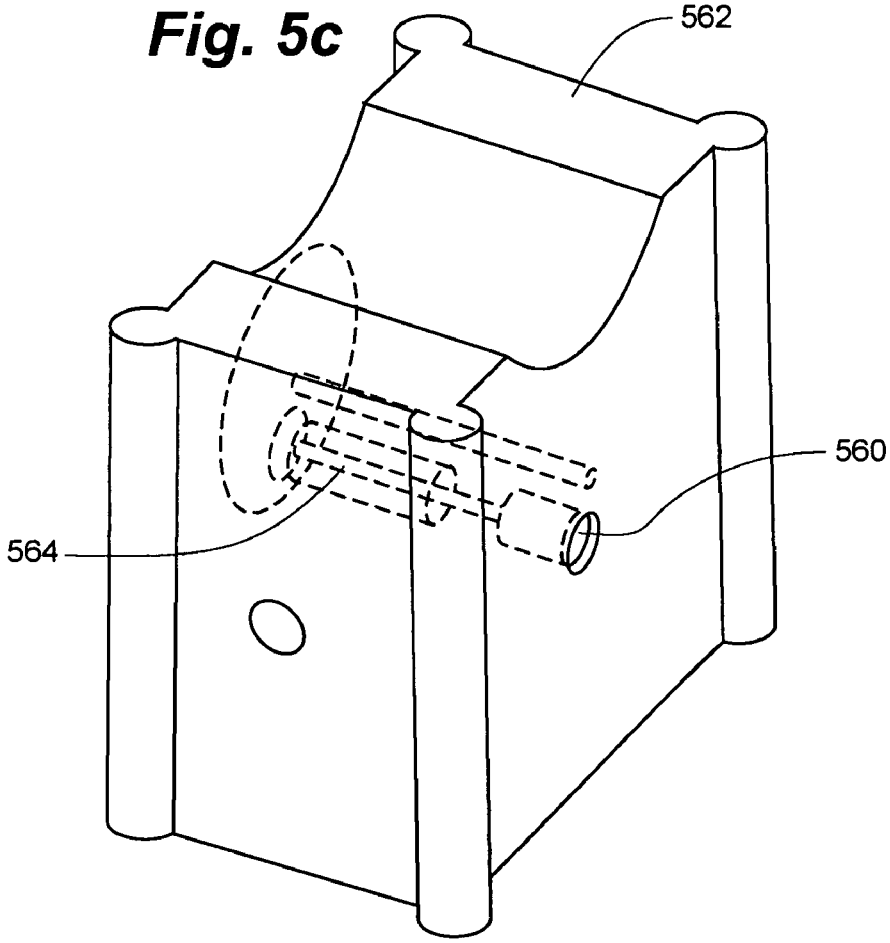
FIG. 5*c* is a drawing illustrating the breech block used in the gun illustrated in FIGS. 6*a* and 6*b*.
Figure 6A:
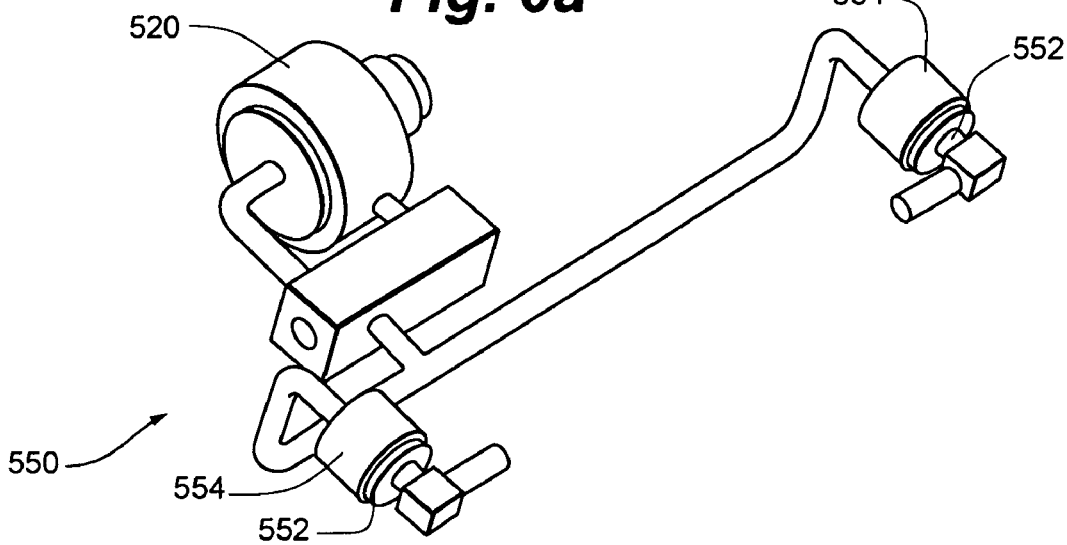
FIG. 6*a* is a perspective view of the air system illustrating a break away connection in the battery position where the air system is in communication with the breech block.
Figure 6B:
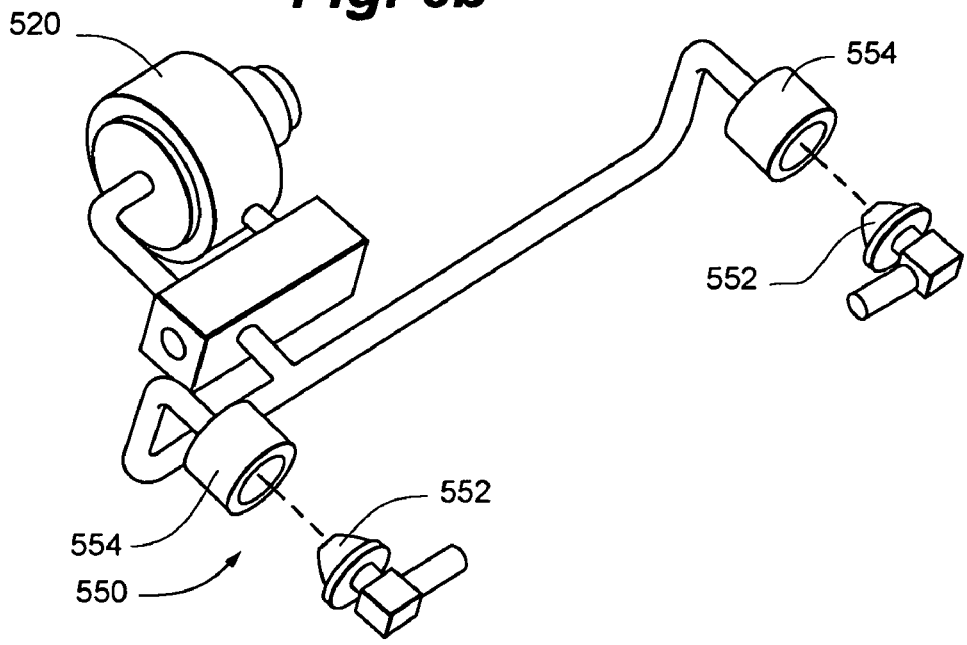
FIG. 6*b* is a perspective view of the air system illustrating the break away connection in full recoil position where the air system is disconnected from the breech block.

FIG. 5*c* shows the poppet valve 560 in the breech block 562. This valve 560 is urged by a compression spring 564 toward a closed position in which the integrity of the breech and the chamber is maintained and is cammed to an open position in which the chamber is in communication with the vacuum air pump 520.

The poppet valve 560 is similar to the type of valves used for exhaust and intake on internal combustion engines. Thus, the poppet valve 560 is normally held tightly against a seat by the compression spring 564, and is lifted off of its seat by a cam, which cam may be shifted by a solenoid, for example.

Figure 7:
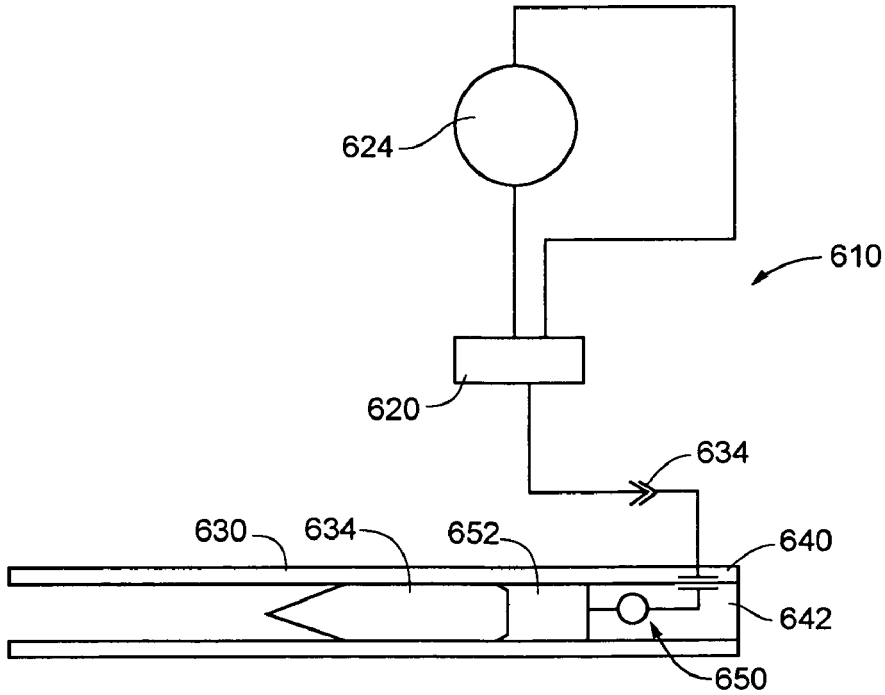
FIG. 7 is a schematic drawing of one embodiment of the present invention illustrating its application to a gun having a sliding breech block utilizing a unidirectional pump in which the vacuum side is normally connected through a manually shiftable valve to a poppet valve in the breech block. The manual valve can be selectively shifted to connect the pressure side to the breech when the poppet valve is opened to eject a misfired round, to evacuate burning embers or to cool the gun tube.

FIGS. 7-10 provide schematic illustrations of various configurations for the in bore air regulation system of the present invention. In particular, FIG. 7 depicts the in bore air regulation system 610 using the valve 620 with a single direction pump 624.

Changing the position of the valve 620 enables air to be drawn out of or into the barrel 630. A breakaway connection 634 is preferably provided between the air pressure regulation system 610 and the gun barrel 630.

A sliding seal 640 is preferably provided between gun barrel 630 and the breech 642 to enable the breech 642 to be removed from the gun barrel 630. A valve 650 is provided in the breech 642 to separate the in bore air generation system 610 from the bore 652 when firing the round 654.

Figure 8:
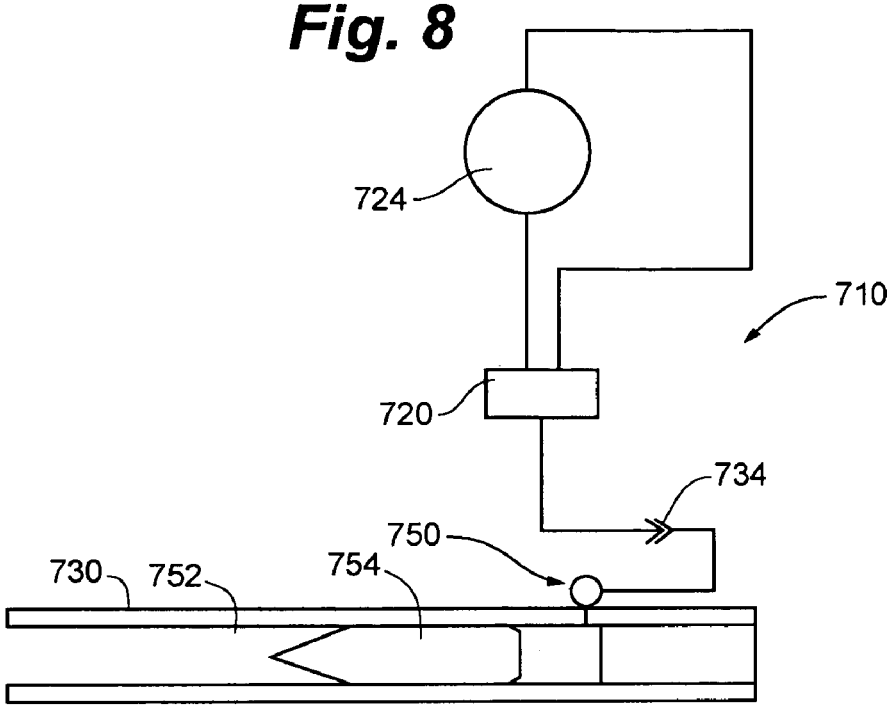
FIG. 8 is a schematic drawing, similar to FIG. 8, of another embodiment of the invention in which the poppet valve communicates with the breech through the side of the barrel rather than being incorporated into the breech block.

FIG. 8 illustrates the in bore air regulation system 710 using a valve 720 with a single direction pump 724. Changing the position of the valve 720 air to be drawn out of or into the barrel 730. A breakaway connection 734 is preferably provided between the air pressure regulation system 710 and the gun barrel 730. A valve 750 is provided in the barrel 730 to separate the in bore air generation system 710 from the bore 752 when firing the round 754.

Figure 9:
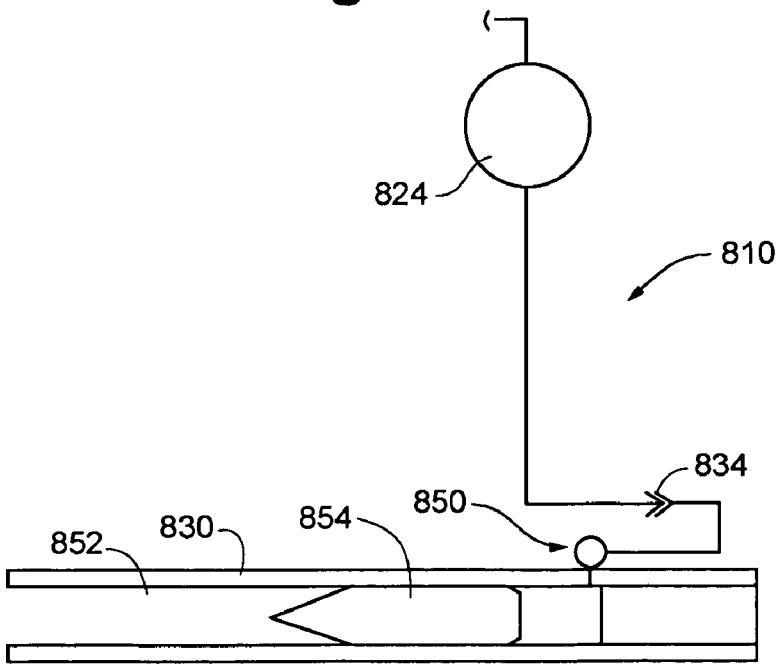
FIG. 9 is a schematic drawing, similar to FIG. 9, of another embodiment of the invention in which a reversible, positive displacement pump is connected directly to the breech through the poppet valve.

FIG. 9 is similar to the embodiment illustrated in FIG. 8 but the in bore air regulation system 810 includes a reversible pump 824. A breakaway connection 834 is preferably provided between the air pressure regulation system 810 and the gun barrel 830. A valve 850 is provided in the barrel 830 to separate the in bore air generation system 810 from the bore 852 when firing the round 854.

Figure 10:
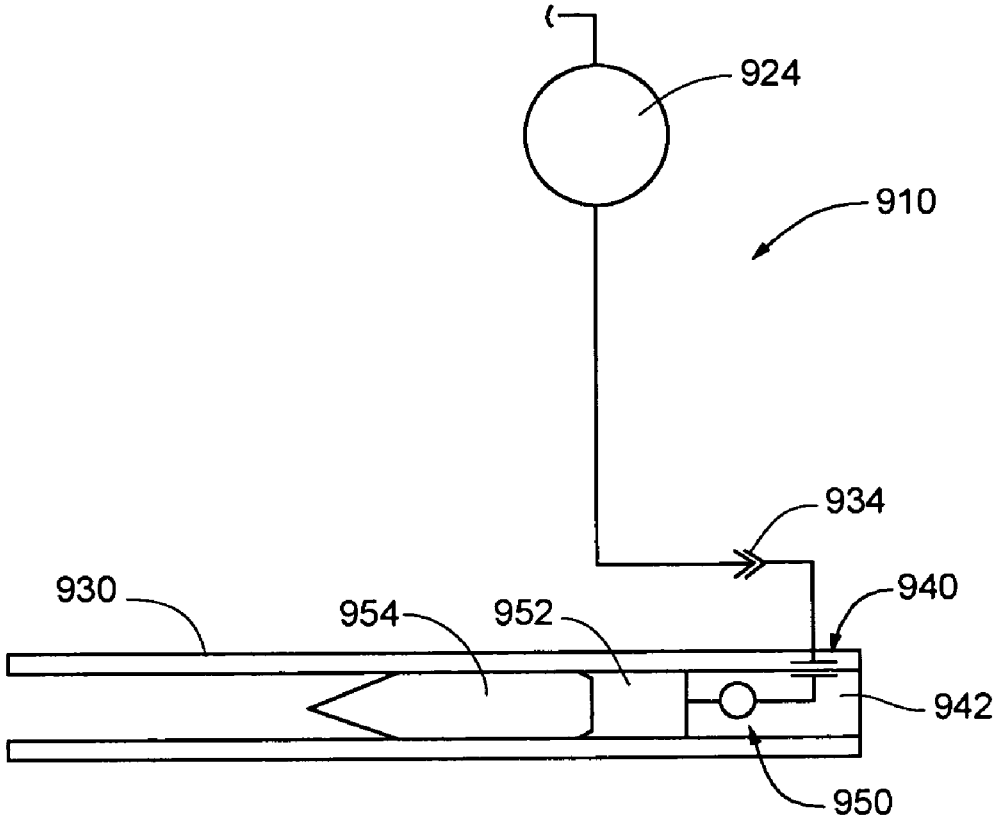
FIG. 10 is a schematic drawing of another embodiment of the invention illustrating its application to a gun having a sliding breech block and employing a reversible, positive displacement pump.

FIG. 10 is similar to the embodiment illustrated in FIG. 7 but the in bore air regulation system 910 includes a reversible pump 924. A breakaway connection 934 is preferably provided between the air pressure regulation system 910 and the gun barrel 930.

A sliding seal 940 is preferably provided between gun barrel 930 and the breech 942 to enable the breech 942 to be removed from the gun barrel 930. A valve 950 is provided in the breech 942 to separate the in bore air generation system 910 from the bore 952 when firing the round 954.

Figure 11:
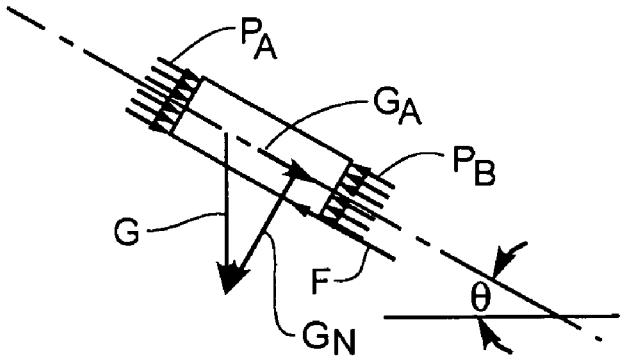
FIG. 11 is a schematic representation of the forces acting on a mortar round just prior to firing when in an arrangement according to the present invention.

FIG. 11 schematically illustrates the forces acting on the round. Force created by pressure is the product of the pressure and the area on which the pressure acts. Atmospheric pressure PA acting on the left end of the round creates a force equal to the cross sectional area of the round times the pressure PA that force urges the mortar round toward the right. i.e., the breech end of the gun tube.

The pressure in the breech PB creates a force acting in the opposite direction. Since the areas on which the pressure PA and PB act are equal, the two opposing pressure forces will be equal when the pressure in the breech PB is at atmospheric pressure PA.

Another force acting on the round is the force of gravity G, which force can be resolved into a force GA acting along the axis of the gun tube and a force GN, which is normal to the axis of the gun tube. The force GN creates a frictional force F, which is equal to the coefficient of friction times the normal force GN.

When the angle ø between the centerline of the gun tube and horizontal is sufficiently large, the force GA will be greater than the friction force F causing the round 10 to move into engagement with the face of the breech block. Since the coefficient of sliding friction for the materials involved is less than the coefficient of static friction, once the round begins to slide in the gun tube, it will move all the way into engagement with the face of the breech block.

However, as the angle ø is decreased, the axial component GA of the force of gravity G will also decrease and the friction force F will increase because the normal force GN will also increase. As a consequence, when the angle ø is sufficiently small, the component GA will be insufficient to assure the round is in engagement with the face of the breech block.

Under such circumstances, creating a vacuum in the breech, i.e., reducing the pressure PB in the breech block below atmospheric, will create a pressure differential on the round, which pressure differential will create a net force, which when added to the force GA, will urge the round into engagement with the face of the breech block.

In operation, the round is inserted through the breech end of the barrel. Thereafter, the breech is closed and the in bore air regulation system is activated to draw the round against the breech.

Just before it is desired to fire the weapon system, the in bore air regulation system is disconnected from the interior of the barrel with a valve. If the round fails to correctly fire, the defective round may be ejected from the weapon system by injecting air into the barrel with the in bore air regulation system. The force of the air is sufficiently high to eject the round but low enough not to cause the round to be fired.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A weapon system;

the weapon system for use firing a self propelled round, the weapon system comprising:

a muzzle end having a first muzzle end and a second breech end, wherein the gun barrel is elevatable through a range of elevations from negative to positive with respect to the breech end;

a lockable breech disposed proximate the second breech end of the gun barrel, the breech having an open lading position and a locked firing position, a bore defined by the gun barrel, the bore at the second end of the gun barrel accessible to loading a round when the breech is in the open position;

an in bore air regulation system in cooperation with the lockable breech being selectively operably in communication with the bore for selectively applying a vacuum and a positive pressure between the breech and the round, the vacuum being sufficient to bring the round into engagement with the breech and to hold the round in engagement with the breech through the range of elevations of the barrel from negative to positive with respect to the horizontal and the positive pressure being sufficient to expel an unfired round from the barrel without opening the breech.

2. The weapon system of claim 1, wherein the in bore air regulation system is in communication with the bore by means of an aperture defined in the gun barrel.

3. The weapon system of claim 1, wherein the in bore air regulation system is in communication with the bore through the breech.

4. The weapon system of claim 1, wherein the in bore air regulation system further includes a valve system to selectively fluidly isolate the in bore air regulation system from the bore.

5. The weapon system of claim 1, the in bore air regulation system having an air tube, the air tube operably connecting the bore to an air pressure vacuum system that is located on a portion of the weapon system that does not recoil during firing of the weapon system, the air tube having a breakaway connection, the breakaway connection fluidly uncoupling the air tube from the air pressure vacuum system.

6. The weapon system of claim 1, the air regulation system having an air tube, the air tube being operably coupled to the bore using a multi-piece trombone type mechanism, so that the air tube extends and retracts during the recoil movement.

* * * * *

UNITED STATES PATENT AND TRADEMARK OFFICE

CERTIFICATE OF CORRECTION

PATENT NO. : 7,594,465 B2
APPLICATION NO. : 10/794416
DATED : September 29, 2009
INVENTOR(S) : Borgwarth et al.

It is certified that error appears in the above-identified patent and that said Letters Patent is hereby corrected as shown below:

Column 6, Line 22:
Delete "lading" and insert --loading--

Signed and Sealed this

Eighth Day of June, 2010

David J. Kappos

David J. Kappos
*Director of the United States Patent and Trademark Office*